US010174592B2

(12) United States Patent
Dodd

(10) Patent No.: US 10,174,592 B2
(45) Date of Patent: Jan. 8, 2019

(54) WELL STIMULATION AND CLEANING TOOL

(71) Applicant: Rex A. Dodd LLC, San Angelo, TX (US)

(72) Inventor: Rex A. Dodd, San Angelo, TX (US)

(73) Assignee: Rex A. Dodd LLC, San Angelo, TX (US)

( * ) Notice: Subject to any disclaimer, the term of this patent is extended or adjusted under 35 U.S.C. 154(b) by 128 days.

(21) Appl. No.: 15/402,632

(22) Filed: Jan. 10, 2017

(65) Prior Publication Data

US 2018/0195368 A1 Jul. 12, 2018

(51) Int. Cl.
*E21B 41/00* (2006.01)
*E21B 37/08* (2006.01)

(52) U.S. Cl.
CPC ..... *E21B 41/0078* (2013.01); *E21B 37/08* (2013.01)

(58) Field of Classification Search
CPC ..... E21B 41/0078; E21B 37/00; E21B 43/25
See application file for complete search history.

(56) References Cited

U.S. PATENT DOCUMENTS 5,165,438 A 11/1992 Facteau et al.
5,230,389 A * 7/1993 Besson ..... E21B 7/18 137/813
5,893,383 A * 4/1999 Facteau ..... B05B 1/08 137/14
6,029,746 A * 2/2000 Dodd ..... B08B 9/0433 166/222
6,250,388 B1 * 6/2001 Carmi ..... B08B 7/0007 166/249
6,470,980 B1 10/2002 Dodd
7,007,865 B2 3/2006 Dodd
8,316,944 B2 11/2012 Pringle et al.
8,844,651 B2 9/2014 Fripp et al.
2017/0152726 A1 * 6/2017 Ross ..... E21B 37/00

FOREIGN PATENT DOCUMENTS

CN 200510057466 7/2006

OTHER PUBLICATIONS

Morel, "Experimental Study of a Jet-Driven Helmholtz Oscillator," J Fluids Engr 101(3), 383-390 (Sep. 1, 1979).
Z. F. Liao and D. S. Huang, "The Theory and Experimental Study of the Self-Excited Oscillation Pulsed Jet Nozzle," Natural Resources 2013, 4, 395-403 [Published Online Sep. 2013 (http://www.scirp.org/journal/nr)].

* cited by examiner

*Primary Examiner* — Shane Bomar
(74) *Attorney, Agent, or Firm* — Ross Barnes LLP; Monty L. Ross

(57) ABSTRACT

A subterranean well stimulation and cleaning tool comprising an upper chamber, a splitter, at least two diffuser legs having proximal ends in fluid communication with the upper chamber and distal ends in fluid communication with a lower chamber, and a laterally disposed crossover channel connecting the at least two diffuser legs between the proximal and distal ends, whereby fluid pulses are generated inside the upper chamber from a substantially constant fluid flow received into the tool from the well surface and are alternately directed through the at least two diffuser legs and into the lower chamber, where the fluid pulses are intensified prior to discharging them from the tool through a nose block or other device disposed downstream of the tool.

16 Claims, 7 Drawing Sheets

WELL STIMULATION AND CLEANING TOOL

FIELD OF THE INVENTION

This invention relates to a well stimulation and cleaning tool having no moving parts that desirably improves production from subterranean wells, including without limitation production from oil and gas wells, by creating subsurface pulses in a fluid medium that is pumped downhole at a substantially constant flow rate. The fluid medium can be selected from aqueous and non-aqueous liquids, gasses, and foamed liquids, and can further comprises various additives commonly used in such fluids. The subject tool desirably comprises a fluidic switch or oscillator that generates a pulsed fluid flow downhole in combination with a secondary chamber that intensifies the pulsed fluid flow prior to discharging the fluid medium into a well bore. Where a standing fluid is present inside the well bore, the fluidic pulses emanating from the tool are propagated through the standing fluid prior to contacting the surrounding structures or formation. The subject tool can be run on drill pipe or coiled tubing, and is useful for breaking up or dislodging mineral scale, pulverized cement and other particulate debris that clogs or plugs flow channels in wells containing a perforated casing or screen liner, or below the casing, as in open hole conduits. The subject tool is also useful for clearing plugging that can otherwise occur when soil is compacted inside the jets of a well cleaning or stimulation tool as can happen, for example, when an associated nozzle is tagged or bottomed out inside a well bore. Because the tool is creating the fluidic pulsing internally, it not only protects the leg ports from plugging but also keeps any tip or tool that is attached on the downstream side clean and protected from external plugging. The subject tool is also adaptable for use in combination with a jetted drill bit for cutting into a formation during drilling of water or hydrocarbon wells, or with other of an assortment of multi-ported tips or tools that connect to the tool body.

DESCRIPTION OF RELATED ART

Previously known tools and methods for drilling wells, for cleaning well bores and for stimulating hydrocarbon production from wells using pulsating fluids are disclosed, for example, in U.S. Pat. No. 5,165,438 ("Fluidic Oscillator"); U.S. Pat. No. 6,029,746 ("Self-Excited Jet Stimulation Tool for Cleaning and Stimulating Wells"); U.S. Pat. No. 6,470,980 ("Self Excited Drill Bit Sub"); U.S. Pat. No. 7,007,856 ("Self-Adjusting Nozzle"); U.S. Pat. No. 8,316,944 ("System for Pulse-Injecting Fluid into a Borehole"); U.S. Pat. No. 8,844,651 ("Three Dimensional Fluidic Jet Control") and in other patents and publications cited or described in the listed patents.

It is well known from fluid dynamics and the combined application of the Bernoulli Principle and the Coanda Effect that a fluid jet will tend to follow the curvature of the surface rather than continue traveling in a straight line. Applying these principles, some conventional fluidic switches intended for use in downhole applications have been designed with a calibrated entry nozzle or power nozzle that discharges fluid from the nozzle into a lead chamber having a calibrated volume and designed to direct the incoming fluid to "attach to" and follow a desired path through the tool to a predetermined destination, typically a fluid outlet port through which the pressurized fluid flows before contacting a desired target area in a well bore. By adding a splitter and creating an additional flow channel inside the tool, the pressurized fluid flowing through the tool can be made to change directions or follow alternate paths through the switch. This switching is enabled by providing a cross-over channel or vacuum port beneath the splitter that will reduce the pressure in the leg where the fluid stream is not flowing and cause it to switch over to the other leg. Two prior embodiments of such tools are disclosed, for example, in U.S. Pat. No. 5,165,438. Where there are two diffuser legs, the switching action will continue for as long as fluid is pumped through the tool and both legs are able to discharge fluid. However, if one of the legs becomes plugged, the switch will stop working. All the fluid will travel down one flow path and the cyclic pulsing action will stop.

The use of Helmholtz oscillation theory and pulsed jets in downhole applications is also well known and has previously been applied in designing downhole tools as, for example, in U.S. Pat. Nos. 6,029,746 and 6,470,980. At jet velocities, jet instabilities couple with the Helmholtz resonance to produce very powerful chamber-pressure oscillations at a frequency slightly higher than the chamber Helmholtz frequency. The amplitude of these pressure oscillations can reach values approaching six times the jet dynamic pressure. Simultaneously, the exiting flow pulsates at the same frequency with an amplitude of up to 60 percent of the exit jet velocity. See, Morel, "Experimental Study of a Jet-Driven Helmholtz Oscillator," J Fluids Engr 101(3), 383-390 (Sep. 1, 1979).

More recently, Z. F. Liao and D. S. Huang, "The Theory and Experimental Study of the Self-Excited Oscillation Pulsed Jet Nozzle," Natural Resources 2013, 4, 395-403 [Published Online September 2013 (http://www.scirp.org/journal/nr)], reported the use of tricone bits in combination with a self-excited pulsed jet nozzle and for reducing the pressure loss during gas transportation through a pipeline, thereby increasing the volume of gas transported.

SUMMARY OF THE INVENTION

A well stimulation and cleaning tool is disclosed that is configured to be run into a subterranean hydrocarbon or water well on drill pipe, tubing or coiled tubing and to be landed, seated or otherwise positioned within a zone where stimulation or cleaning is desired. The subject tool has no moving internal parts and is desirably configured by means of a fluidic switch to receive a substantially constant flow of fluid medium from one or more pumps located at the surface and to convert the constant flow to an oscillating, pulsed fluid flow inside the tool. Unlike other well tools with fluidic switches that have previously been disclosed, the subject tool comprises spaced-apart upper and lower fluid chambers that are interconnected by laterally spaced-apart diffuser legs providing fluid communication between the chambers. The upper chamber desirably comprises a centrally disposed fluid inlet that discharges fluid into the upper chamber, and a splitter facing the fluid inlet. Pressurized fluid entering the subject tool through the fluid inlet contacts the splitter, and fluid deflected by the splitter produces turbulence within the upper chamber that generates a pulse of pressurized fluid that flows downwardly through one of the diffuser legs and is discharged into the lower chamber, where the pulse is intensified prior to being discharged from the lower chamber into the well bore.

The fluid flow oscillates and alternates between the spaced-apart diffuser legs of the tool because of a lateral crossover channel disposed between the two legs. According to a preferred embodiment of the invention, each diffuser leg has a diverging section and a converging section, and the lateral crossover channel is disposed between the diverging sections of the two legs. As pressurized fluid flows rapidly down one diffuser leg past the open end of the lateral crossover channel intersecting that leg, a vacuum is created on the opposite side that draws the fluid flow to the low-pressure side of the splitter and into to the lower-pressure diffuser leg, thereby causing the fluid stream to switch flow paths from one diffuser leg to another. The diffuser legs desirably have inlet ports located on opposite sides of the splitter at the downstream end of the upper chamber. The diffuser legs each diverge at an acute angle relative to the longitudinal central axis through the tool to a point of maximum separation between the two legs that is located between the upper and lower chambers.

Downstream from the points of maximum separation of the two diffuser legs, the legs begin converging at an acute angle relative to the longitudinal central axis through the tool. In one embodiment of the invention, the two diffuser legs converge until they combine in a "Y" to form a single fluid flow path disposed upstream of a centrally disposed fluid inlet into the lower chamber. In another embodiment of the invention, each of the converging diffuser legs intersects the bottom edge of the tool internal at its distal end and discharges the fluid medium directly into the lower chamber through its own outlet port. It will be appreciated upon reading this disclosure in relation to the accompanying drawings that the acute angles of the diffuser legs relative to the longitudinal axis of the tool can vary according to the distance between the upper and lower chambers, the diameter of the tool internals, and the relative longitudinal distances between the points of maximum separation of the two diffuser legs and the respective upstream (proximal) and downstream (distal) ends of the diffuser legs.

Inside the lower chamber, the oscillating fluid pulses are intensified prior to being discharged from the tool through one or more jet flow nozzles disposed downstream of the lower chamber. In one embodiment of the invention, the lower, or secondary, chamber of the subject tool has side walls defined by a retaining ring that is inserted between and held in place by a nose block, tip or other downstream tool threaded into the downstream end of the tool body. The fluid discharge ports can be disposed in the nose block, in a bit sub, or in any one of an assortment of multi-ported tips or tools that connect to the body of the well stimulation and cleaning tool of the invention, thereby making the attached tool more resistant to being disabled or rendered less effective by plugging of a fluid outlet port.

According to one embodiment of the invention, the subject tool desirably comprises a fluidic switch or oscillator having an upper chamber that generates a pulsed fluid flow inside the tool and directs the pulsed flow alternately through a pair of diffuser legs and into a secondary chamber that intensifies the pulsed fluid flow prior to discharging the fluid medium from the tool. Where a standing fluid is present inside the well bore, the fluidic pulses discharged from the tool are propagated through the standing fluid prior to contacting the surrounding structures or formation. The subject tool is useful for breaking up or dislodging mineral scale, pulverized cement and other particulate debris that clogs or plugs flow channels in wells containing a perforated casing or screen liner, or below the casing, as in open hole conduits. The subject tool is also useful for clearing plugging that can otherwise occur when soil is compacted inside the jets of a well cleaning or stimulation tool as can happen, for example, when an associated nozzle is tagged or bottomed out inside a well bore. Because the tool is pulsing internally, it not only protects the leg ports from plugging but also keeps any tip or tool that is attached on the downstream side clean and protected from external plugging. The subject tool is also adaptable for use in combination with a jetted drill bit for cutting into a formation during drilling of water or hydrocarbon wells, or with other of an assortment of multi-ported tips or tools that connect to the tool body.

A further advantage of the present invention is that the diffuser legs and the crossover channel can have non-circular cross-sections, meaning that the tool internal can be made by cutting a substantially cylindrical steel shaft in half along its longitudinal axis and then machining the fluid flow paths through the diffuser legs as grooves or channels in the facing surfaces. This avoids having to drill the diffuser legs and intersecting lateral crossover channel into a single metal shaft, and then plug off the end of the bore drilled for the crossover channel. If desired, a cooperating tongue and groove can also be machined into oppositely disposed, facing surfaces of the tool internals to limit relative movement of the two halves during assembly of the subject tool. A substantially cylindrical retainer ring can be machined from a hollow steel shaft of suitable dimensions that is cooperatively sized and configured to slidably engage the inside wall of the tool body and also serve as the inside wall of the lower chamber.

During assembly of the tool, the two halves of the tool internal and the retainer ring can desirably be placed into facing and contacting engagement with each other and then lubricated with white oil on the outwardly facing surfaces to aid in sliding them smoothly inside the tool body. Optionally, one half of the tool internal can be fabricated with one or more lips or projections disposed at or near the perimeter and is engageable with a cooperatively sized and configured recess in the other half to resist relative sliding movement between the two halves as they are placed in facing and abutting contact with each other and inserted into the open lower end of the tool body. After the tool internal and retainer ring are inserted into the tool body, they can be held in place by standard threaded connections disposed between the tool body and other elements of the string.

The subject well stimulation and cleaning tool comprises a fluidic switch that is specially configured by the provision of a second, longitudinally spaced-apart chamber inside the tool to alleviate stoppage of pulsating fluid flow due to plugging of an outlet port downstream of the splitter. More particularly, one embodiment of the subject tool is desirably configured to recombine divergent flow paths through the diffuser legs into a single pulsed fluid flow channel disposed below the splitter that is discharged into the secondary chamber before the pulsed fluid flow reaches the tool exit port or ports. The recombined, pulsed fluid flow then exits the tool from the secondary chamber through one or a plurality of discharge ports and creates a cyclic shock wave in the backside fluid (fluid disposed between the tubing and the well bore) that is propagated in all directions and significantly exceeds the magnitude of the force experienced using a well stimulation or cleaning tool having a non-pulsating jet flow or having a conventional oscillation chamber disposed above the splitter and the same number and configuration of discharge ports operating at the same fluid throughput. Furthermore, the improved tool configuration of the present invention is particularly effective for unplugging ports that have become blocked without tripping the tool.

In the subject tool, recombination desirably occurs downstream of any crossover channel or vacuum port disposed in the splitter. The divergent fluid flow paths through a splitter can be recombined by causing them to converge and intersect to form a common fluid flow path or by causing each of them to flow into a third fluid path that interconnects the downstream ends of the two diffuser legs and provides a common fluid collecting passage that establishes fluid communication between the lower end of each of the legs and the fluid discharge port or ports of the tool. This recombination of fluid flow paths enables the tool to continue producing a pulsed flow upstream of any plugging or blockage in one or more fluid discharge ports, and further intensifies that pulsed flow in the secondary chamber to assist in removing the plugging or blockage so as not to totally or partially disable the tool downhole or require tripping the tool to unplug the discharge ports.

According to another embodiment of the invention, a well stimulation and cleaning tool is disclosed that comprises a fluid switch with a splitter having diffuser legs that are not redirected into a single flow path at the bottom of the splitter but are instead configured to discharge pulsed fluid exiting each of the splitter legs directly into a secondary chamber disposed downstream of the splitter to intensify the magnitude of the fluid pulses before the fluid exits the tool through one or more fluid discharge ports and to protect the diffuser legs of the well stimulation and cleaning tool and the fluid discharge ports of any nose block or other tool attached to the downstream side of the well stimulation and cleaning tool from plugging.

According to yet another embodiment of the invention, a bit sub is disclosed that is structurally analogous to one or more of the embodiments disclosed above except that the porting is desirably larger to prevent washing of the ports and plugging of the bit ports.

The subject tool is desirably threaded onto the bottom of a string of drill pipe, tubing or coiled tubing and is run into the well bore to the top of the production zone. Where, as often occurs, fluid is already standing inside the hole, a check valve is desirably provided to prevent fluid from rising up through the tool and into the tubing. When the tool is run down to the bottom of the production zone, fluid flow lines are connected to the tubing string at the surface, the tubing is loaded with fluid, and the pumps are then started to pump fluid downwardly through the tool. The hydraulic shock waves generated by the fluid switch are intensified in the secondary chamber of the subject tool and are effective for breaking up scale inside the bore, for improving the permeability and porosity of the formation, and for opening up the fluid discharge ports of the tool should plugging occur.

BRIEF DESCRIPTION OF THE DRAWINGS

The apparatus of the invention is further described and explained in relation to the following drawings wherein.

Figure 1:
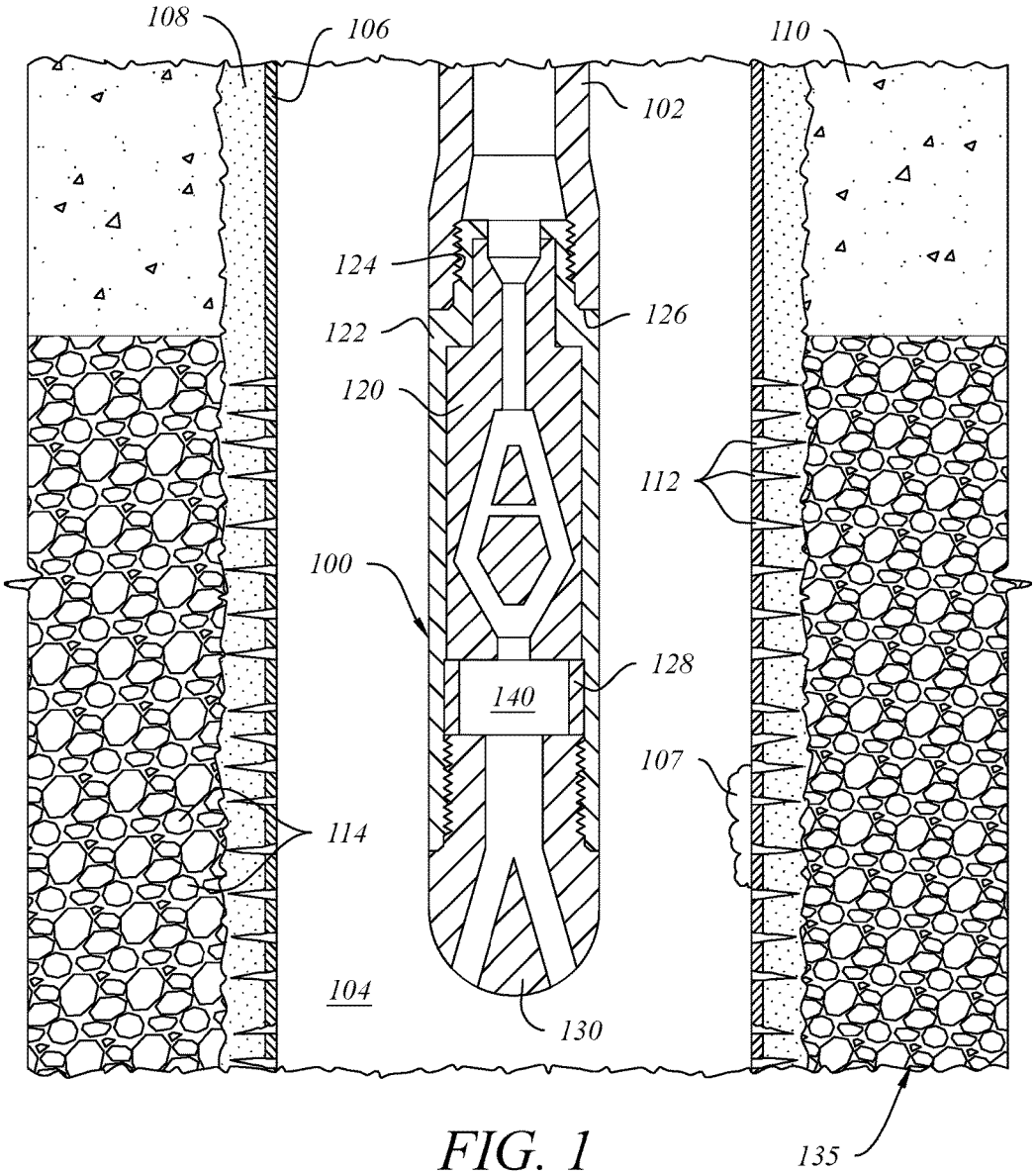
FIG. 1 is a cross-sectional elevation view through a producing section of well bore in which one embodiment of the well stimulation and cleaning tool of the invention is depicted as being suspended inside a perforated casing that is cemented inside a well bore.

It should be appreciated that the accompanying figures are not drawn to scale, so that lengths, diameters, relative proportions and angles are not necessarily as depicted in the drawings. For simplification, no distinction is made in the drawings between tapered and straight NPT threads, which will be apparent to those of skill in the art.

DESCRIPTION OF PREFERRED EMBODIMENTS

Referring to FIG. 1, tool 100 is depicted as being suspended from tubing 102 inside bore 104 of a subterranean well in which casing 106 is held in place by cement 108. Casing 106 further comprises a plurality of perforations 112 through which the surrounding formation 110 (as depicted above perforations 112) has been fractured into smaller particles 114 to increase its permeability. At one location inside casing 106, mineral scale 107 has formed on the inside of the casing and has blocked some of perforations 112, thereby reducing the ability to inject fluids or proppants into or recover fluids from formation 135. Tool 100 further comprises tool body 122 having an externally threaded pin end 124 that engages the internally threaded box end of tubing 102, with downwardly facing shoulder 126 of tubing 102 shown in abutting contact with an upwardly facing annular collar of tool body 122. Tool internal 120 (one of two opposed halves) is disposed in sliding engagement with tool body 122 and retainer ring 128 defining lower chamber 140 is disposed beneath tool internal 120. The externally threaded pin end of nose block 130 is shown in threaded engagement with the internally threaded lower end of tool body 122. The internal flow paths through tool 100 are further described in relation to FIGS. 4-6 below.

Figure 2:
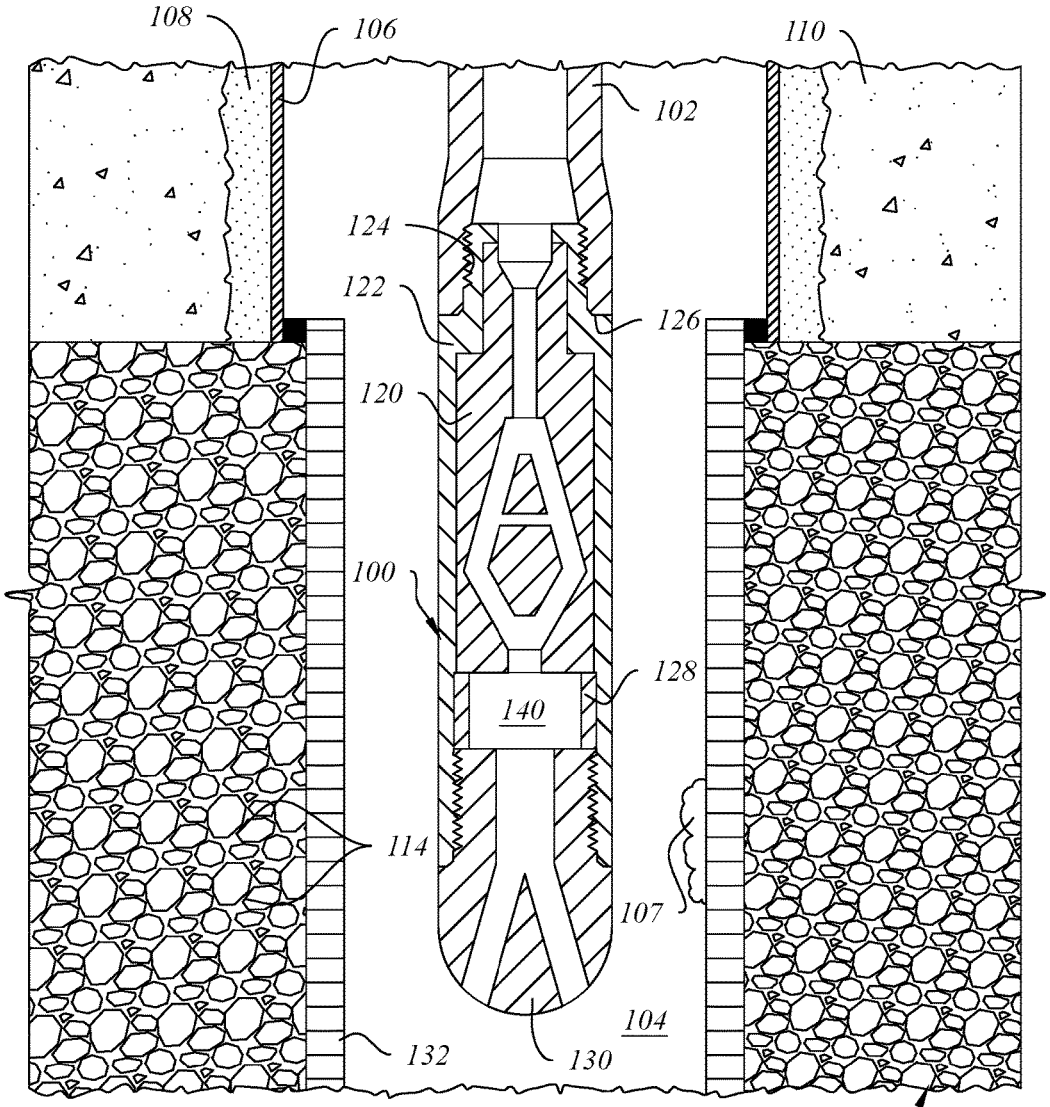
FIG. 2 is a cross-sectional elevation view through a producing section of well bore in which one embodiment of the well stimulation and cleaning tool of the invention is depicted as being suspended inside a screen liner disposed below a perforated casing that is cemented inside a well bore.
Figure 3:
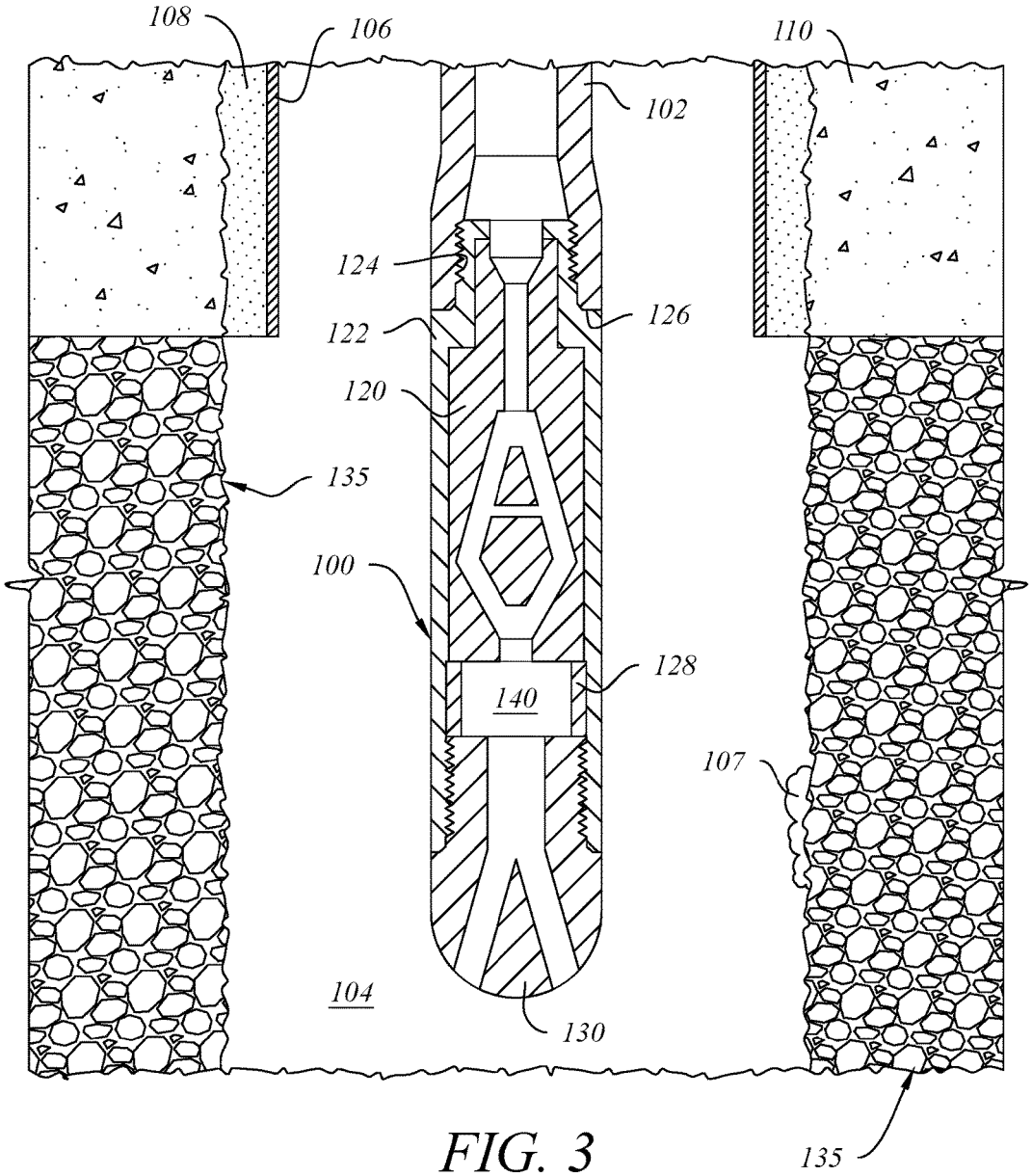
FIG. 3 is a cross-sectional elevation view through a producing section of well bore in which one embodiment of the well stimulation and cleaning tool of the invention is depicted as being suspended inside an open bore disposed below a perforated casing that is cemented inside a well bore.

Referring to FIG. 2, tool 100 is the same as mentioned above but is shown suspended inside a section of bore 104 in which screen liner 132 is disposed in a fractured producing zone 135 beneath a section of casing 106 held by cement 108 in formation 110. A small deposit of scale 107 is shown on the inside surface of screen liner 132 opposite the lower end of tool 100. Referring to FIG. 3, tool 100 is the same as mentioned above but is shown suspended inside an open section of bore 104 in which screen liner 132 is disposed in a permeable producing zone 135 beneath a section of casing 106 held by cement 108 in formation 110. A small deposit of scale 107 is shown on the inside surface of bore 104 opposite the lower end of tool 100.

Referring generally to FIGS. 1-3, well cleaning and stimulation tool 100 is desirably threaded into engagement with the bottom of the tubing string and run into the well bore to the top of the producing zone where the stimulation and/or cleaning is to occur. If fluid is already standing in the well bore, a check valve is desirably provided to prevent fluid from moving up inside the tubing before the surface pump is activated. Once tool 100 is in place, tubing 102 is loaded with fluid medium and pumping through tool 100 is initiated from the surface. As fluid medium begins moving through tool 100, fluidic switching begins automatically even though there are no moving parts inside tool 100. Through testing with various port, flow channel and chamber sizes, I have found that the shape of the ports and flow channels (i.e., whether they have circular or non-circular, such as square, cross-sections) does not significantly affect performance of tool 100, and the Coanda effect is not relied upon to produce the fluidic switching. Also, because of the fluidic switching inside tool 100, a resonance is created on tool 100 and the pipe or tubing from which it is suspended that controls cyclic buckling and drag. This advantage is particularly helpful when running coiled tubing, and helps tool 100 to have extended reach capabilities in horizontal drilling applications. This benefit can be illustrated with reference to a linear segment of water hose lying on the ground. Even with water running continuously through the hose segment, the hose cannot be pushed very far along the ground before it starts to buckle. However, if someone grasps the hose segment and begins to shake it back and forth to establish patterned undulations in the movement of the hose, it becomes possible to push the hose segment significantly farther along the ground.

Figure 4:
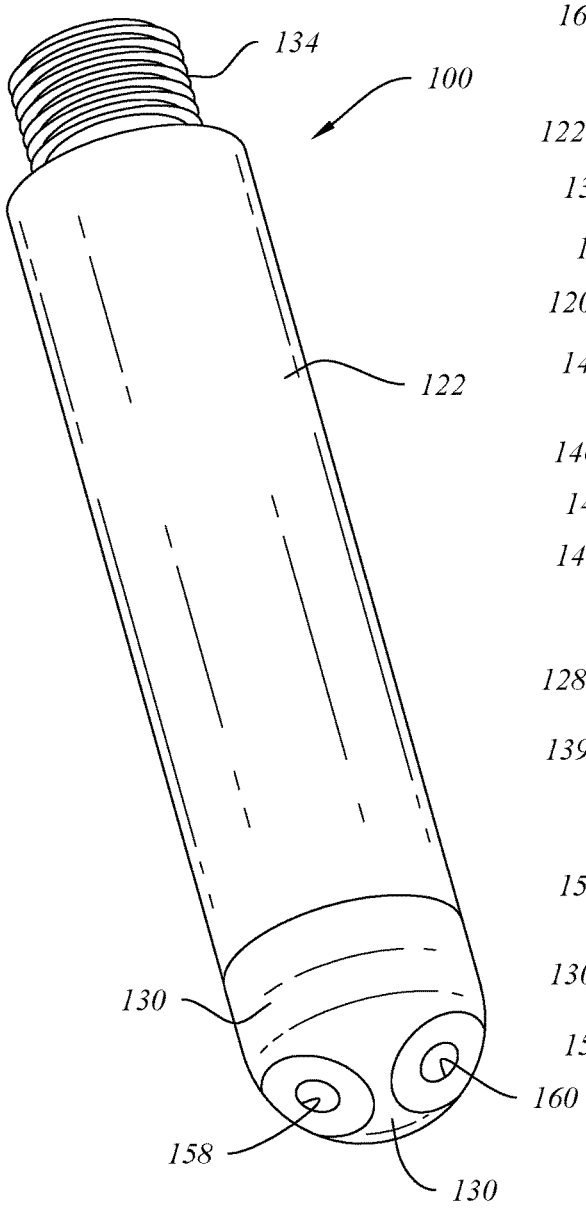
FIG. 4 is a perspective view of one embodiment of a well stimulation and cleaning tool of the invention.
Figure 5:
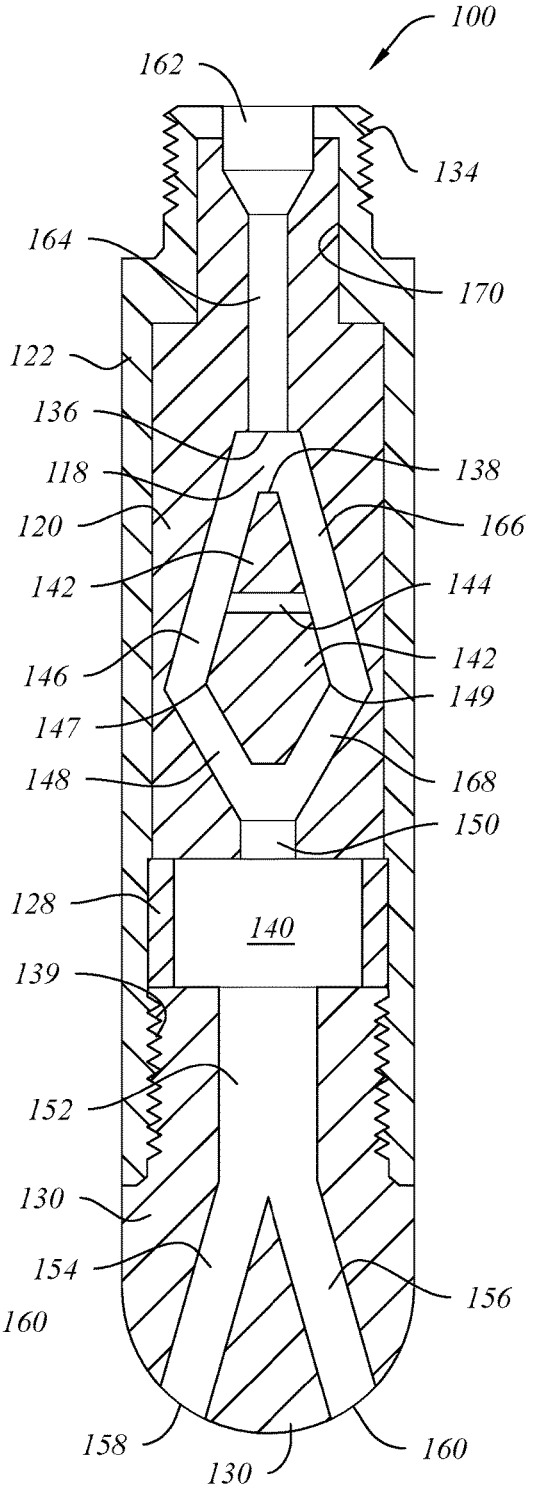
FIG. 5 is a cross-sectional, front elevation view through the tool of FIG. 4.
Figure 6:
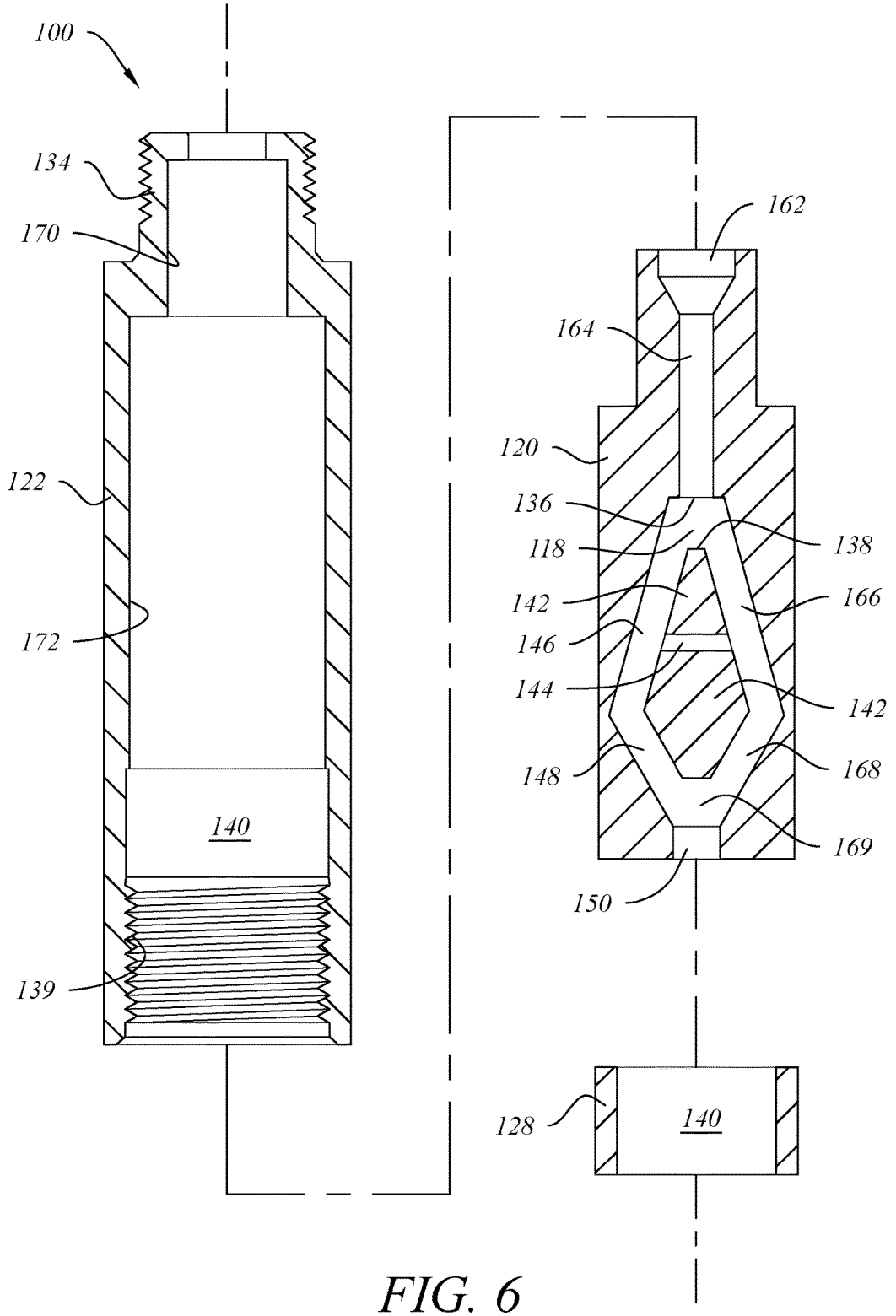
FIG. 6 is an exploded cross-sectional elevation view of the tool of FIG. 5 without the nose block containing the fluid discharge ports.

Referring to FIGS. 4-6, one embodiment of well cleaning and stimulation tool 100 is shown in perspective, cross-sectional and exploded cross-sectional views, respectively. Tool 100 comprises three principal parts, including tool body 122, tool internal 120, and retaining ring 128, all of which are desirably made of steel but can also be made of any other similarly effective and wear-resistant and corrosion-resistant metal alloy other material. It should also be appreciated upon reading the disclosure that contact surfaces and discharge orifices, outlets and especially jet-flow nozzles, provided for use in conjunction with the present invention can be constructed of or coated with special materials different from the material(s) for use in fabricating major portions of the three principal parts of tool 100. The assembled tool as disclosed in FIGS. 4 and 5 desirably comprises two parts—tool internal 120 and retaining ring 128—that are sequentially inserted into sliding engagement with the stepped internal bore 170, 172 (FIG. 6) of tool body 122 prior to threading nose block 130 into engagement with female threaded section 139 to secure tool internal 120 and retaining ring 128 tightly inside tool body 122. If desired, a lubricant such as white oil can be applied to the outside surfaces of tool internal 120 and retaining ring 128 prior to assist in inserting them into tool body 122.

Referring to FIGS. 5-6, tool internal 120 is desirably machined from a cylindrical steel shaft that is first necked down to fit inside stepped interior bore 170 of tool body 122 and is then bored at each end to create centrally disposed cylindrical bores sections 162, 164 separated by a tapered transition section at one end and cylindrical bore 150 at the other. Tool internal 120 is then desirably cut in half along its longitudinal axis to form two mirror-image halves by any suitable, commercially available means. Only one of the two mirror-image halves is shown in the longitudinal cross-sectional view of FIG. 6. Once the mirror-image halves of tool internal 120 have been formed, the other structural elements and flow channels can be formed in each half of tool internal 120 by any suitable and commercially available machining method or metal cutting technology.

Flow channels disposed in this embodiment of tool 100 include without limitation upper chamber 118, diverging diffuser leg segments 146, 166, converging diffuser leg segments 148, 168, crossover channel 144 providing fluid communication between diverging diffuser leg segments 146, 166, and "Y" section 169 where converging diffuser leg segments 148, 168 flow into cylindrical bore 150. Referring to FIG. 5, points of maximum separation 147, 149 of the two spaced-apart diffuser legs are desirably disposed downstream of crossover channel 144 and represent the point where diverging diffuser leg segments 146, 166 transition to converging diffuser leg segments 148, 168, respectively, that are combined into single cylindrical bore 150 above lower chamber 140. It will be appreciated by the reader that only one half of cylindrical bore sections 162, 164, the transition section between them, bore 150 and crossover channel 144 are visible in FIGS. 5-6, with the other cooperating half of each flow channel being disposed in the opposite half that is not shown. If desired, cross-bores can also be provided in the solid portions of the two halves to permit the insertion of positioning pins that can restrict relative movement between the two halves of tool internal 120 prior to inserting tool internal 120 into tool body 122. As previously stated, upper channel 118, "Y" section 169, the four segments 146, 148, 166, 168 of the two diffuser legs and crossover channel 144 are not required to have cylindrical or semi-cylindrical cross-sections, so that flow channels having non-circular (e.g., square or rectangular) cross-sections can be satisfactorily used within the scope of the invention. Retaining ring 128 is desirably a cylindrical steel ring having smooth sides and dimensions suitable for defining lower chamber 140 within its interior space.

Still referring to FIGS. 5-6, upper chamber 118 of tool internal 120 is formed below power nozzle 136, which desirably introduces a substantially constant flow of pressurized fluid medium into upper chamber 118. Directly opposite power nozzle 136 is a substantially flat surface of splitter 138 that physically separates the inlet ends of oppositely disposed, diverging leg segments 146, 166. The outside wall of splitter 138 also forms part of the inside walls of the diffuser legs. Because of the expansion and pressure drop that occur in the flow of fluid medium as the pressurized fluid medium passes through power nozzle 136 and enters upper chamber 118, and because of the rebound effects that occur when fluid medium contacts splitter 138, a turbulent horizontal vortex is created inside upper chamber 118. When the vortex (or "ball" of fluid) becomes larger than the internal volume of upper chamber 118, the "ball" of fluid will follow the path of least resistance downwardly through one or the other of diverging leg sections 146, 166. The volume and configuration of upper chamber 118 and splitter 138 relative to the diameter of power nozzle 136 and the distance between power nozzle 136 and splitter 138 produce the turbulence needed for fluid medium discharged from power nozzle 136 against splitter 138 during use of tool 100 to move downwardly through one or the other of diverging leg segments 146, 166, following the path of least resistance. According to one embodiment of the invention, the longitudinal distance between power nozzle 136 and splitter 138 is about three times the diameter of power nozzle 136.

As the fluid medium is pressured down one or the other of diverging leg segments 146, 166, the fluid medium will pass by the smaller diameter crossover channel 144, which will act as a Venturi tube and cause the opposite diverging leg segment (the "non-flowing leg") to have a lower pressure relative to the pressure in the first leg (the "flowing leg"). Because the pressure in the leg segment where the fluid medium is flowing is greater than the pressure in the opposite switch leg, the next "ball" of fluid developing inside upper chamber 118 will travel down low-pressure leg, thereby creating a "fluidic switch." When operating in this fashion, the two opposed legs are sometimes referred to as "switch legs." This switching action will continue as long as fluid is pumped through power nozzle 136 of tool 100 and the distal ends of both switch legs remain open. As used in this description, it should be appreciated that the fluid medium used with well stimulation and cleaning tool 100 can comprise aqueous and non-aqueous liquids, gasses and mixtures of liquid and gasses, including without limitation foamed liquids.

The fluid exiting the distal (downstream) ends of the switch legs creates a pulsing action because flow in each leg is "switched" by the pressure differential at the opposite ends of crossover channel 144. Because the medium pulse that leaves tool 100 is at a higher velocity than the fluid (air or standing liquid) in which it is suspended, the pulse creates a cyclic pressure or stress wave. In prior tools, if switch leg became plugged, the tool would stop switching. In the present invention, however, the pulsing fluid flow exiting the switch legs is directed into a lower chamber 140 in which the pulsing is further intensified prior to exiting tool 100. This protects the switch legs from becoming plugged during use and also means that the intensified fluid pulses exiting lower chamber 140 are available to reduce the likelihood of plugging in the fluid discharge ports of nose block 130 or other tool attached to the downstream side of tool 100 and also clear any plugging or other debris that temporarily blocks or partially occludes such ports or jet flow nozzles installed in such downstream tools.

Figure 7:
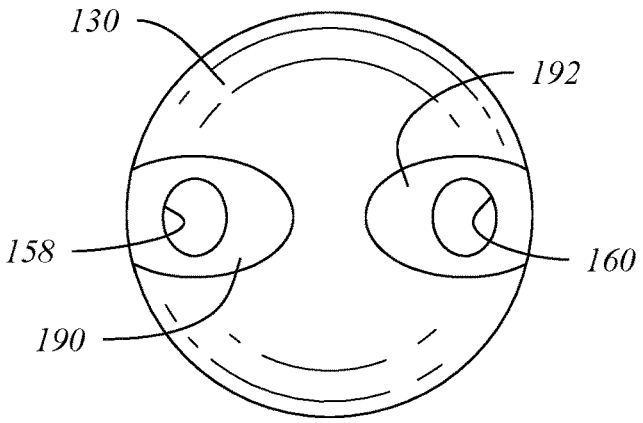
FIG. 7 is a bottom plan view of one embodiment of a nose block suitable for use in combination with the well tool of the invention and comprising two fluid discharge ports.
Figure 8:
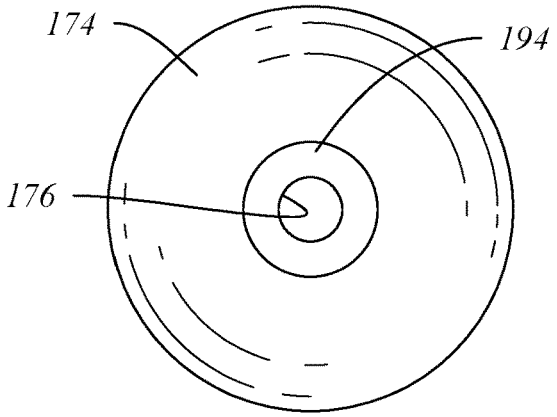
FIG. 8 is a bottom plan view of another embodiment of a nose block suitable for use in combination with the well tool of the invention and comprising a single fluid discharge port.
Figure 9:
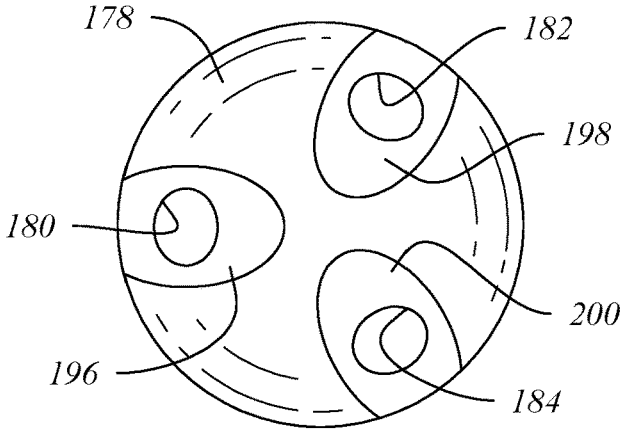
FIG. 9 is a bottom plan view of one embodiment of a nose block suitable for use in combination with the well tool of the invention and comprising three fluid discharge ports.

Referring to FIGS. 4-5, 7 nose block 130 has internal fluid flow channels 152 and 154, 156 disposed in fluid communication with fluid outlet ports 158, 160 and surrounded by relief areas 190, 192, respectively (or jet nozzles, now shown, that can be installed in fluid outlet ports 158, 160). Nose block 130 is merely illustrative of various different conventional tools as previously described in the Summary of the Invention that can be attached to the bottom of tool 100 to direct fluid pulses discharged from lower chamber 140 of tool 100 as needed inside bore 104 (FIGS. 1-3) to effectuate the purposes for which the pulsed, pressurized fluid is being discharged into the bore. For example, referring first to FIGS. 8-9, respectively, nose block 174 having a single outlet port 176 surrounded by relief area 194 and nose block 178 having three outlet ports 180, 182, 184, surrounded by relief areas 196, 198, 200, can similarly be used in combination with well stimulation and cleaning tool 100 to achieve particular benefits in relation to the pulsating fluid medium that is discharged from tool 100. As previously stated above, the subject tool is also adaptable for use in combination with a jetted drill bit for cutting into a formation during drilling of water or hydrocarbon wells, and with other of an assortment of multi-ported tips or tools that can be connected to tool body 122.

Because the fluid medium inside tool 100 and nose block 174 is moving faster and has more momentum and kinetic energy than any fluid present inside well bore 104, the pulses of fluid medium exiting tool 100 and nose block 174 create a cyclic shock wave in the backside fluid that propagates in all directions inside bore 104 (FIGS. 1-3) to achieve beneficial results. Tool 100 is desirably calibrated to switch from about 90 to about 120 times per second. The majority of scale or fill (e.g., sand) in a well bore are either layered or stacked. When the cyclic shock waves contact scale, the scale flexes until the layers fatigue and break, much like bending a length of wire back and forth until it fatigues and breaks. With stacked particles of sand, the cyclic shock waves travel into the gaps between particles and push the particles apart until they are entrained in the fluid medium and returned to the surface through the annulus between the drill pipe or tubing and the casing.

Figure 10:
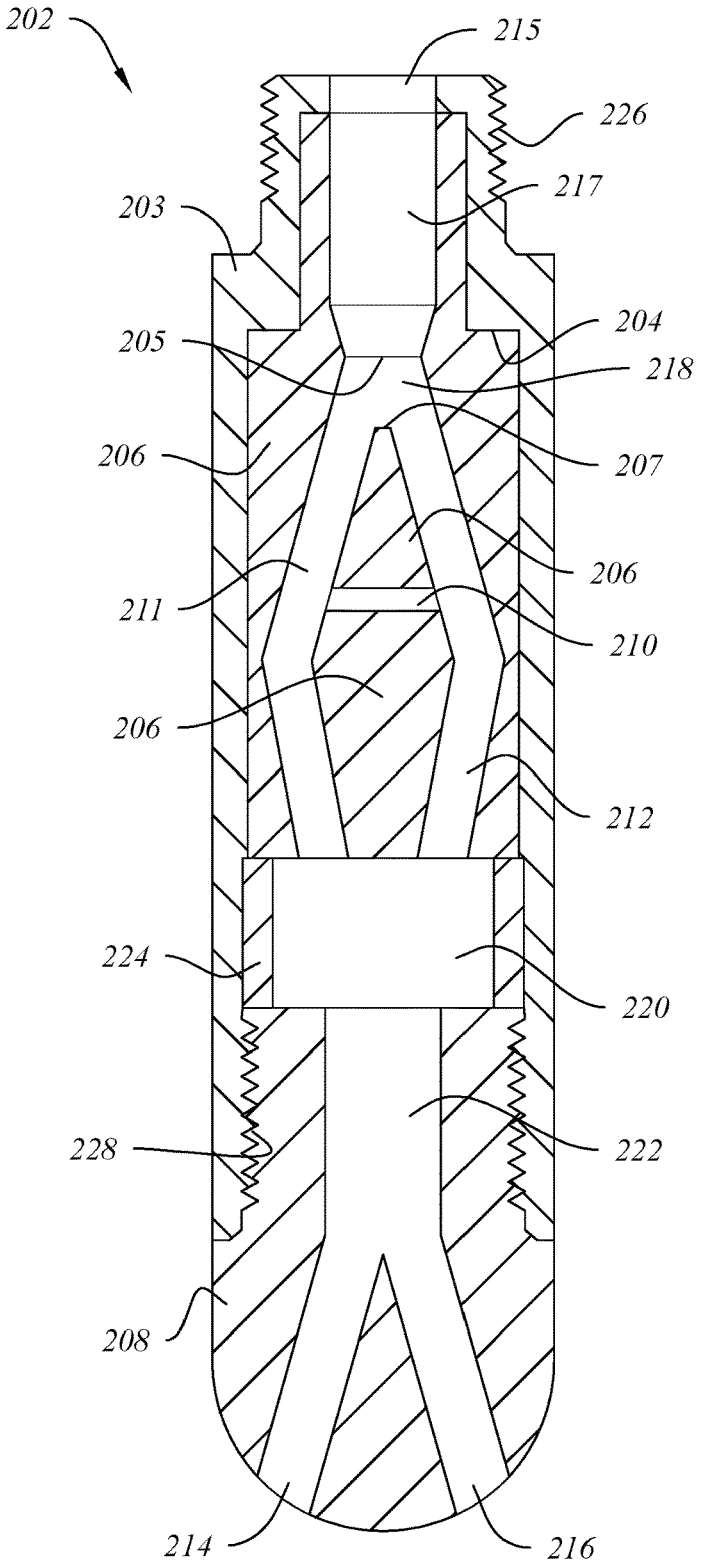
FIG. 10 is a cross-sectional elevation view of another embodiment of the invention wherein the diffuser legs of the splitter are each discharged directly into a secondary chamber disposed downstream of the splitter and upstream of the fluid discharge ports of the nose block.

Referring to FIG. 10, another embodiment of the invention is disclosed in which well stimulation and cleaning tool 202 comprises as its principal parts tool body 203 having a stepped inside bore, tool internal 206 (one of two opposed halves), and retaining ring 224. With the exception of the fluid flow paths entering lower chamber 220, each of the principal parts is constructed and functions in substantially the same manner as discussed above in relation to tool 100 of FIGS. 5-6. Tool body 203 further comprises inlet 215, externally threaded upper section 226 and internally threaded lower section 228. Tool internal 206 further comprises inlet bore 217 disposed above a transition section communicating with power nozzle 205 that discharges fluid medium into upper chamber 218. A substantially flat splitter 207 is disposed opposite power nozzle 205 that separates the laterally spaced inlets into diffuser (switch) legs 211, 212 that are interconnected in the divergent leg segments by crossover channel 210. In tool 202, unlike tool 100 as previously described, each of diffuser legs 211, 212, discharges the pulsed fluid medium directly into lower chamber 220 through its own outlet. Here, as with tool 100, lower chamber 220 is provided to receive, intensify and then discharge the pulsed fluid medium into a downstream tool or tip such as nose block 208, which is depicted with inlet bore 222 that bifurcates into a plurality of spaced-apart fluid discharge ports 214, 216. As described in relation to tool 100, tool 202 also provides the capabilities and benefits of discharging intensified fluid pulses while simultaneously protecting diffuser legs 211, 212 from plugging that could otherwise terminate the pulsed fluid flow, and of cleaning out plugging that may occur in the discharge ports of an attached downstream tool or tool tip. These benefits avoid the loss of performance due to plugging and the need for tripping a tool that has been rendered ineffective or substantially less effective due to accidental plugging of diffuser legs or discharge ports. Further, these benefits are achieved through use of the present invention without the need for moving parts in the tool that can otherwise pose other operational problems or difficulties. Mechanical tools are not very reliable in downhole conditions, especially in geothermal wells, whereas a fluidic tool as disclosed herein can withstand the harshest of conditions and also prevent or clear plugging while in place downhole.

Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventor and Applicant are legally entitled.

What is claimed is:

1. The A well stimulation and cleaning tool comprising: an upper chamber, a lower chamber, two laterally spaced-apart diffuser legs establishing at least part of a fluid flow path between the upper chamber and the lower chamber, a crossover channel providing fluid communication between the two diffuser legs, and at least one fluid outlet port disposed downstream of the lower chamber;

wherein the upper chamber comprises an inlet port for pressurized fluid, a splitter disposed downstream of and opposite to the fluid inlet port, and an opening into each of the two diffuser legs, each said opening being disposed on an opposite side of the splitter;

wherein the upper chamber, splitter, diffuser legs and crossover channel are all formed in a tool internal; and wherein the tool internal and a retaining ring slidably engage a substantially cylindrical tool body.

2. The well stimulation and cleaning tool of claim 1 wherein each of the two laterally spaced-apart diffuser legs has a diverging section and a converging section.

3. The well stimulation and cleaning tool of claim 2 wherein the crossover channel provides fluid communication between the diverging sections of each of the two laterally spaced-apart diffuser legs.

4. The well stimulation and cleaning tool of claim 2 wherein the converging section of each laterally spaced-apart diffuser leg has a distal end that communicates directly with the lower chamber.

5. The well stimulation and cleaning tool of claim 1 wherein each diffuser leg has a distal end communicating directly with the lower chamber.

6. The well stimulation and cleaning tool of claim 1 wherein the two laterally spaced-apart diffuser legs are consolidated into a single fluid flow path prior to entering the lower chamber.

7. The well stimulation and cleaning tool of claim 1 wherein the inlet port of the upper chamber has a diameter equal to about one third the distance between said inlet port and the splitter.

8. The well stimulation and cleaning tool of claim 1 wherein the upper chamber, the two diffuser legs and the crossover channel cooperate to produce a pulsed fluid flow in a pressurized fluid medium passing downwardly through the tool that periodically switches back and forth between the two diffuser legs.

9. The well stimulation and cleaning tool of claim 8 wherein the pulsed fluid flow switches between the two diffuser legs from about 90 to about 120 times per second.

10. The well stimulation and cleaning tool of claim 8 wherein the lower chamber intensifies the fluid pulses that are received into the lower chamber from the two diffuser legs.

11. The well stimulation and cleaning tool of claim 1 wherein the lower chamber further comprises a side wall configured as a retaining ring.

12. The well stimulation and cleaning tool of claim 1 wherein the lower chamber is configured to discharge a pulsed fluid medium into another downstream tool.

13. The well stimulation and cleaning tool of claim 12 in combination with another downstream tool selected from the group consisting of a nose block, drill bit or drill bit sub.

14. The well stimulation and cleaning tool of claim 1 wherein the tool internal is divided longitudinally into halves.

15. The well stimulation and cleaning tool of claim 1 wherein the tool body is threadedly engageable with and suspended from a conduit selected from drill pipe, tubing and coiled tubing.

16. The well stimulation and cleaning tool of claim 1 wherein each diffuser leg has a distal end disposed in fluid communication with a single fluid flow path disposed between the two diffuser legs and the lower chamber.

* * * * *